US005659857A

United States Patent [19]

Yamazaki et al.

[11] Patent Number: 5,659,857

[45] Date of Patent: Aug. 19, 1997

[54] IMAGE FORMING METHOD

[75] Inventors: Masuo Yamazaki, Yokohama; Koichi Tanigawa, Tokyo; Katsuhiko Nishimura, Yokohama, all of Japan

[73] Assignee: Canon Kabushiki Kaisha, Tokyo, Japan

[21] Appl. No.: 350,106

[22] Filed: Nov. 29, 1994

[30] Foreign Application Priority Data

Nov. 29, 1993 [JP] Japan ..... 5-320890

[51] Int. Cl.[6] ..... G03G 15/08

[52] U.S. Cl. ..... 399/252; 430/109; 430/111; 430/137

[58] Field of Search ..... 355/200, 210, 355/245, 271, 272, 274, 277, 282, 285, 326 R, 327; 118/645, 653; 430/109, 110, 111, 113, 114, 115, 137; 219/216; 399/252, 222, 223, 320

[56] References Cited

U.S. PATENT DOCUMENTS

| | | | |
|---|---|---|---|
| 3,391,082 | 7/1968 | Maclay . | |
| 4,299,903 | 11/1981 | Auclair et al. | 430/137 |
| 4,590,142 | 5/1986 | Yamazaki et al. | 430/138 |
| 4,626,490 | 12/1986 | Yamazaki et al. | 430/138 |
| 4,656,111 | 4/1987 | Wakamiya et al. | 430/109 |
| 4,797,344 | 1/1989 | Nakahara et al. | 430/138 |
| 4,904,562 | 2/1990 | Yusa et al. | 430/138 |
| 4,973,541 | 11/1990 | Kohri et al. | 430/111 |
| 4,996,126 | 2/1991 | Anno et al. | 430/109 X |
| 5,041,878 | 8/1991 | Takai et al. | 355/272 X |
| 5,087,939 | 2/1992 | Mcdougal | 355/200 |
| 5,172,168 | 12/1992 | Satoh et al. | 355/245 |
| 5,187,526 | 2/1993 | Zaretsky | 355/273 |
| 5,291,251 | 3/1994 | Storlie et al. | 355/271 |
| 5,305,061 | 4/1994 | Takama et al. | 355/245 X |
| 5,314,774 | 5/1994 | Camis | 355/245 X |
| 5,354,640 | 10/1994 | Kanbayashi et al. | 430/110 |
| 5,357,330 | 10/1994 | Hauser | 355/326 R |
| 5,407,776 | 4/1995 | Kanbayashi et al. | 430/137 |
| 5,424,819 | 6/1995 | Menjo | 219/216 X |

FOREIGN PATENT DOCUMENTS

| | | |
|---|---|---|
| 0374851 | 6/1990 | European Pat. Off. . |
| 0430674 | 6/1991 | European Pat. Off. . |
| 0415727 | 6/1991 | European Pat. Off. . |
| 36-10231 | 5/1961 | Japan . |
| 56-13945 | 4/1981 | Japan . |
| 59-50473 | 3/1984 | Japan . |
| 59-53856 | 3/1984 | Japan . |
| 59-61842 | 4/1984 | Japan . |
| 59-125739 | 7/1984 | Japan . |

OTHER PUBLICATIONS

Patent Abstracts of Japan, vol. 11, No. 142 (P–573) [2589], May, 1987 for JP–A–61–279864.

Patent Abstracts of Japan, vol. 13, No. 475 (P–950) [3823], Oct., 1989 for JP–A–1–186964.

*Primary Examiner*—Sandra L. Brase

*Attorney, Agent, or Firm*—Fitzpatrick, Cella, Harper & Scinto

[57] ABSTRACT

An image forming method, comprising the steps of forming an electrostatic image on a electrostatic image-bearing member, developing the electrostatic image with toner particles having a first shape factor (SF-1) of 100–150 and containing a low-softening point substance to form a toner image on the electrostatic image-bearing member, transferring the toner image on the electrostatic image-bearing member to an intermediate transfer member which has been voltage-applied, transferring the toner image on the intermediate transfer member to a transfer-receiving material by a transfer means which has been voltage-applied, and heat-fixing the toner image on the transfer-receiving material. The toner particles may preferably have a second shape factor (SF-2) of 100–140. The total of SF-1 and SF-2 may preferably at most 275, particularly at most 240, for improving transfer efficiency of the toner particles. The low-softening point substance may preferably be an ester wax having a long-chain (e.g., $\geqq C_{10}$) alkyl group. The image forming method is effective in providing a high-quality (full-color) toner image with high transfer efficiency and free from toner sticking.

41 Claims, 3 Drawing Sheets

CROSS SECTION OF
TONER OF EXAMPLE 1

IMAGE FORMING METHOD

FIELD OF THE INVENTION AND RELATED ART

The present invention relates to an image forming method wherein a toner image formed on an electrostatic image-bearing member is transferred to an intermediate transfer member, further transferred to a transfer-receiving material, and heat-fixed on a transfer-receiving material.

The present invention also relates to an image forming method applicable to copying machines, printers, facsimile machines, etc.

Heretofore, in full-color copying apparatus, there have generally been used full-color image forming method wherein electrostatic images formed on four photosensitive members are developed with a cyan toner, a magenta toner, a yellow toner, and a black toner, respectively, and the respective resultant toner images are transferred on a transfer-receiving material conveyed by a belt-like transfer member or wherein a transfer-receiving material is wound about the surface of a transfer receiving material-bearing member disposed opposite to one photosensitive member by the action of electrostatic force or mechanical force and an electrostatic image is subjected to developing-transfer steps four times.

In recent years, a transfer-receiving material for a full-color image has been required to meet the needs of a smaller sized paper such as cardboard, card or postcard paper. In the above-mentioned image forming method using four photosensitive members, a transfer-receiving material is conveyed in the form of a plate or a sheet, so that such an image forming method can employ various transfer-receiving materials but is required to accurately superpose plural toner images on a prescribed position of the transfer-receiving material, thus resulting in a lowering in image quality even when a slight registration error is caused to occur. In order to enhance registration accuracy, the image forming method encounters a problem such that a conveying mechanism of the transfer-receiving material is complicated to increase parts or components therefor. On the other hand, in the image forming method of attaching the transfer-receiving material to the transfer-receiving material-bearing member thereby to wind it about the transfer-receiving material-bearing member and performing developing-transfer steps four times, when a cardboard having a large basis weight is used as a transfer-receiving material, such a transfer-receiving material has a high stiffness and causes adhesion failure to the transfer-receiving material-bearing member at the back end of the transfer-receiving material. As a result, such a transfer-receiving material is liable to cause an image defect due to transfer failure. Similarly, the image defects are also caused to occur in the case of the smaller sized paper in some cases.

There have been proposed some image forming methods using an intermediate transfer member.

For example, U.S. Pat. No. 5,187,526 describes a full-color image forming apparatus using a drum-like intermediate transfer member, U.S. Pat. No. 5,187,526, however, it does not specifically describe a shape of toner particles and a structure thereof.

Japanese-Laid Open Patent Application (JP-A) 59-125739 discloses a recording method wherein a toner image formed by using toner particles having an average particle size of at most 10 μm is once transferred to an intermediate transfer member and then further transferred to a transfer-receiving material and also discloses a direct toner production process using suspension polymerization as one of toner production processes. However, the transfer step in JP-A 59-125739 is performed by pressing transfer or adhesive transfer, so that the surface of the intermediate transfer member is stained or contaminated during a copying of a large number of sheets, thus being differentiated from a transfer step of transferring a toner image by using electrical attraction force under an electric field.

JP-A 59-50473 describes an electrostatic recording method or electrophotographic copying method wherein a toner image formed on an image-bearing member is once transferred to an intermediate transfer member comprising a support heated at a prescribed temperature, a heat-resistant elastic layer formed on the support, and a surface layer comprising an addition polymerization-type silicone rubber disposed on the elastic layer and is further transferred to a transfer-receiving material. The image forming method disclosed in JP-A 59-50473, however, is liable to cause a deterioration of the image-bearing member because the image-bearing member is in contact with the heated intermediate transfer member. In addition, JP-A 59-50473 fails to describe a transfer step using a voltage-applied intermediate transfer member.

As described above, a transfer step using an intermediate transfer member requires a two-step transfer wherein a toner image is once transferred from an electrostatic image-bearing member such as a photosensitive member to the intermediate transfer member and the transferred toner image to the intermediate transfer member is again transferred to a transfer-receiving material, so that a transferability (or a transfer ratio) of the toner image (or toner particles) is required to enhance its level so as to be higher than a conventional level.

SUMMARY OF THE INVENTION

An object of the present invention is to provide an image forming method using a intermediate transfer member having solved the above-mentioned problems.

Another object of the present invention is to provide an image forming method showing an excellent transfer efficiency of a toner image.

Another object of the present invention is to provide an image forming method capable of effectively transferring a toner image to a small-size transfer-receiving material such as cardboard, card or postcard paper.

Another object of the present invention is to provide an image forming method having suppressed toner sticking or filming onto the surface of an electrostatic image-bearing member or an intermediate transfer member.

Another object of the present invention is to provide an image forming method excellent in forming a multi-color image or a full-color image.

Another object of the present invention is to provide an image forming method capable of forming a color OHP image excellent in transparency on an OHP film.

A further object of the present invention is to provide an image forming method capable of forming a highly minute multi-color image or full-color image by using a plurality of color toners having a good low-temperature fixability and an excellent color-mixing characteristic.

A still further object of the present invention is to provide an image forming method capable of effectively forming a multi-color image or a full-color image without using silicone oil for preventing an occurrence of an offset phenomenon at the time of fixing under application of heat and pressure.

According to the present invention, there is provided an image forming method, comprising the steps of:

forming an electrostatic image on a electrostatic image-bearing member, developing the electrostatic image with toner particles having a first shape factor (SF-1) of 100–150 and containing a low-softening point substance to form a toner image on the electrostatic image-bearing member, transferring the toner image on the electrostatic image-bearing member to an intermediate transfer member which has been voltage-applied, transferring the toner image on the intermediate transfer member to a transfer-receiving material by a transfer means which has been voltage-applied, and heat-fixing the toner image on the transfer-receiving material.

According to the present invention, there is also provided an image forming method for forming a full-color image, comprising the steps of:

forming an electrostatic image on a electrostatic image-bearing member, developing the electrostatic image with color toner particles having a first shape factor (SF-1) of 100–110 and containing a low-softening point substance in an amount of 5–30 wt. % to form a color toner image on the electrostatic image-bearing member, transferring the color toner image on the electrostatic image-bearing member to an intermediate transfer member which has been voltage-applied, transferring the color toner image on the intermediate transfer member to a transfer-receiving material by a transfer roller which has been voltage-applied, and heat-fixing the color toner image on the transfer-receiving material.

These and other objects, features and advantages of the present invention will become more apparent upon a consideration of the following description of the preferred embodiments of the present invention taken in conjunction with the accompanying drawings.

DETAILED DESCRIPTION OF THE INVENTION

In the present invention, toner particles are characterized by having a specific first shape factor (SF-1) and a specific second shape factor (SF-2). The first shape factor (SF-1) shows a degree of roundness and the second shape factor (SF-2) shows a degree of unevenness.

The SF-1 and SF-2 may be determined as follows.

Figure 2:
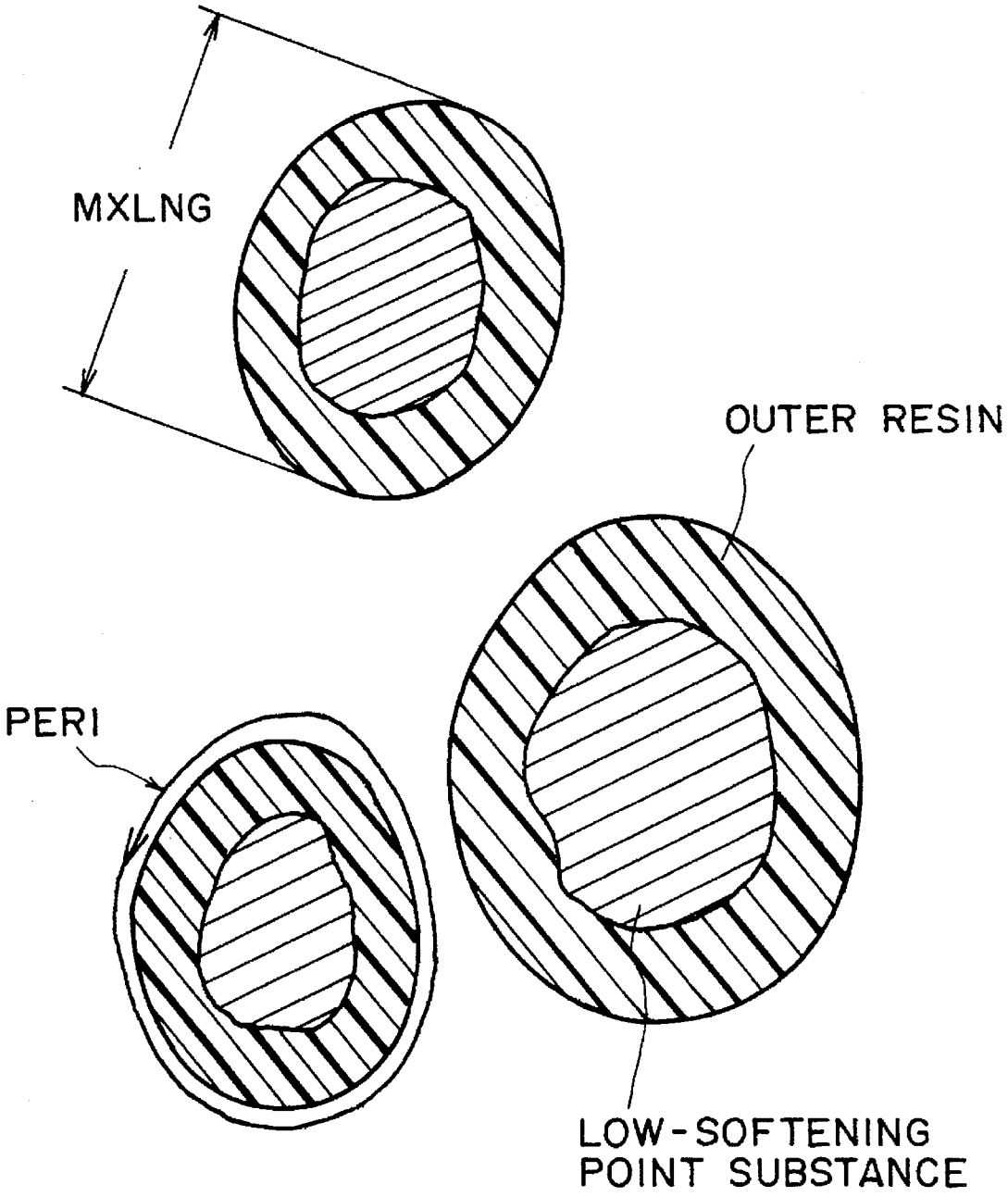
FIG. 2 is a schematic illustration of a cross-section of toner particles used in Example 1 appearing hereinafter.

100 toner images observed through a field-emission scanning electron microscope (FE-SEM) (e.g., "S-800", available from Hitachi Ltd.) at a magnification of 500 are chosen and sampled at random. The resultant image data of the toner images are inputted into an image analyzer (e.g., "Luzex III, available from Nireco K.K.) through an interface, whereby SF-1 and SF-2 are determined based on the following equations:

$$SF\text{-}1=[(MXLNG)^2/AREA]\times(\pi/4)\times100,$$

$$SF\text{-}2=[(PERI)^2/AREA]\times(1/4\pi)\times100,$$

wherein MXLNG denotes the maximum diameter of a toner particle, AREA denotes the projection area of a toner particle, and PERI denotes a perimeter (i.e., a peripheral length of the outer surface) of a toner particle, for example, as shown in FIG. 2.

Toner particles produced by a method comprising the steps of melt-kneading and pulverization (so-called, "pulverization method") have an irregular shape and generally have an SF-1 above 150 and an SF-2 above 140. In the case of using a full-color copying machine wherein plural toner images are developed and transferred, an amount of toner particles placed on a photosensitive member is increased when compared with that in the case of a monochrome (white-black) copying machine only using a black toner. As a result, it is difficult to improve transfer efficiency of toner particles by only using conventional toner particles having an irregular shape. In addition, if such toner particles having an irregular shape are used in the full-color copying machine, sticking or filming of the toner particles onto the surface of a photosensitive member or the surface of an intermediate transfer member due to shearing force or frictional force between plural members, such as, the photosensitive member and a cleaning member, the intermediate transfer member and the cleaning member, and the photosensitive member and the intermediate transfer member, may occur. Thus, in the case of forming a full-color toner image, it is difficult to uniformly transfer the toner image. Further, if a intermediate transfer member is used therefor, some problems in respects of color unevenness and color balance are liable to occur, so that it is not easy to stably output high-quality full-color images.

In case where toner particles have an SF-1 in excess of 150, the shape of the toner particles differs from a sphere and is closer to an irregular shape, thus causing a lowering in transfer efficiency of a toner image at the time of a transfer from an electrostatic image-bearing member to an intermediate transfer member. As a result, a lowering in transfer efficiency of the toner image at the time of a transfer from the intermediate transfer member to a transfer-receiving material is also confirmed. In order to improve the transfer efficiencies of the toner image, toner particles my preferably have an SF-1 of 100–150, more preferably 100–125, further preferably 100–110.

In case where toner particles have an SF-2 in excess of 140, the surface of the toner particles is not smooth but is uneven, so that the above-mentioned two transfer efficiencies (i.e., from the electrostatic image-bearing member to intermediate transfer member and from the intermediate transfer member to the transfer-receiving material) are liable to be lowered. In order to improve such transfer efficiencies of the toner image, toner particles may preferably have an SF-2 of 100–140, more preferably 100–130, further preferably 100–125.

As described above, the toner particles may preferably have a high sphericity (i.e., closer to an SF-1 of 100) and also a even surface shape or a decreased degree of surface unevenness (i.e., closer to an SF-2 of 100) in order to further improve the above-mentioned transfer efficiencies. Accordingly, the toner particles may preferably have an SF-1 of 100–125 and an SF-2 of 100–130, particularly an SF-1 of 100–110 and an SF-2 of 100–125.

In order to transfer an toner image to various transfer-receiving materials, an intermediate transfer member is used. As a result, a transfer step is substantially performed two times, so that a lowering in transfer efficiency is considerably liable to cause a lowering in toner utilization efficiency. In a digital full-color copier or printer, it is required to reproduce a multi-color image faithful to an original in such a manner that a color image original is color-decomposed into its various colors in advance by using three color filters of B (blue), G (green) and R (red) and formed into dotted latent images of 20–70 μm a photosensitive member and then developed with four color toner particles comprising Y (yellow) toner particles, M (magenta) toner particles, C (cyan) toner particles and B (black) toner particles by utilizing subtractive color process. At this time, a large amount of total toner particles of Y toner, M toner, C toner and B toner is placed on the photosensitive member or the intermediate transfer member in accordance with color data from the original or a CRT (cathode ray tube), so that the respective color toner particles used in the present invention are required to show a very high transferability. In order to realize such a transferability, the toner particles used in the present invention may preferably have be those having a substantially spherical shape (i.e., an SF-1 closer to 100) and a substantially smooth surface (i.e., an SF-2 closer to 100).

In the present invention, in order to faithfully develop minute latent image dots for providing a further high-quality image, the toner particles may preferably have a weight-average particle size of 4–8 μm and a coefficient of variation (A) in number (on number-basis particle size distribution) of at most 35%. In the case of the toner particles having a weight-average particle size below 4 μm, a transfer efficiency or a transfer rate is lowered and a large amount of toner particles is left on the photosensitive member or intermediate transfer member. In addition, such toner particles are liable to cause a ununiform and uneven toner image due to fog or transfer failure, thus being unsuitable for toner particles used in the present invention. On the other hand, in the case of the toner particles having a weight-average particle size in excess of 8 μm, the toner particles are liable to cause toner sticking onto various members such as a photosensitive member and an intermediate transfer member. This tendency is further pronounced in the case of the toner particles having a coefficient of variation in number above 35%.

The weight-average particle size of the toner particles used in the present invention can be measured, e.g., by using a Coulter counter, while the weight-average particle size can be measured in various known manners.

Coulter counter Model TA-II (available from Coulter Electronics Inc.) is used as an instrument for measurement, to which an interface (available from Nikkaki K.K.) for providing a number-basis distribution and a volume-basis distribution, and a personal computer CX-1 (available from Canon K.K.) are connected thereto.

For measurement, a 1%-NaCl aqueous solution as an electrolyte solution is prepared by using a reagent-grade sodium chloride (e.g., "ISOTON® II", available from Coulter Scientific Japan Co.). To 100 to 150 ml of the electrolyte solution, 0.1 to 5 ml of a surfactant, preferably an alkylbenzenesulfonic acid salt, is added as a dispersant, and 2 to 20 mg of a sample is added thereto. The resultant dispersion of the sample in the electrolyte liquid is subjected to a dispersion treatment for about 1–3 minutes by means of an ultrasonic disperser, and then subjected to measurement of particle size distribution in the range of 2–40 μm by using the above-mentioned Coulter counter Model TA-II with a 100 micron-aperture to obtain a number-basis distribution. From the results of the number-basis distribution, the weight-average particle size of the toner may be obtained.

The coefficient of variation (A) of the toner particles used in the present invention may be defined by the following equation:

Coefficient of variation (A) (%)=$(S/\overline{D}_1)\times 100$, wherein S denotes a standard deviation on number-basis distribution of the toner particles, and $\overline{D}_1$ denotes a number-average particle size (μm) of the toner particles.

In the present invention, the toner particles contains a low-softening point substance (i.e., a substance showing a low-softening point). The low-softening point substance may preferably provide a DSC curve, as measured by a differential scanning colorimeter according to ASTM D3418-8, showing a temperature of 40°–90° C. corresponding to a maximum heat absorption peak. If such a temperature is below 40° C., the low-softening point substance is lowered in its self-cohesive force, thus resulting in a decreased anti-offset characteristic at high temperature. On the other hand, if the temperature is above 90° C., a fixation temperature is increased, so that it is difficult to moderately smooth the surface of a fixed image, thus resulting in a lowering in a color-mixing characteristic. In the case of producing toner particles by direct polymerization (appearing hereinbelow), steps of forming a particle and polymerization are performed in aqueous medium, so that low-softening point substance precipitates principally in the step of forming a particle if the above-mentioned temperature is high (e.g., above 90° C.).

Measurement of the temperature corresponding to a maximum heat absorption peak on a DSC curve described above may be performed by using, e.g., a commercially available differential scanning calorimeter ("DSC-7" (trade name), manufactured by Perkin-Elmer Corp.). In the apparatus, temperature correction at a sensor portion is effected by using melting points of indium and zinc and correction of heat quantity at the sensor portion is effected by using a heat of fusion of indium. A sample is placed on an aluminum pan and a blank pan is set for reference. The DSC measurement is performed by heating (temperature increase) at a rate of 10° C./min.

The low-softening point substance used in the present invention may preferably have a softening point of 40°–150° C.

Examples of the low-softening point substance may include paraffin wax, polyolefin wax, Fischer-Tropsch wax, amide wax, higher fatty acid, ester wax, and derivatives thereof (e.g., grafted compounds thereof and blocked compounds thereof).

Plural color toners used in a full-color copier are required to be sufficiently mixed with each other at a fixation step, so that an improvement in color reproducibility or a transparency of an OHP image become an important factor. As a result, the respective color toners may preferably use a resin having a sharp melting characteristic and a low-molecular weight in comparison with the black toner. The black toner generally use a releasing agent, having a relatively high crystallinity or crystallizability, such as polyethylene wax or polypropylene wax, in order to improve a high-temperature anti-offset characteristic at the fixation step. On the other hand, however, in the case of the color toner, such a releasing agent impairs a transparency of an outputted toner image on an OHP film due to its crystallinity. For this reason, the color toners are generally constituted by not using a releasing agent. The color toners are used in combination with a silicone oil to be uniformly applied to a hot fixation roller, thus resulting in an improvement in the high-temperature anti-offset characteristic. However, the thus obtained transfer-receiving material having thereon a fixed toner image still has an excessive silicone oil at the surface, so that such a surface state makes users unpleasant when used.

Accordingly, the low-softening point substance used in the present invention may preferably be one not impairing a transparency of an OHP image and having an excellent high-temperature anti-offset characteristic. Specifically, in the present invention, the low-softening point substance may preferably be an ester wax having at least one (more preferably at least two) long-chain alkyl group having 10 or more (more preferably 18 or more) carbon atoms. Such an ester wax may particularly preferably be those represented by the following formulae (I), (II) and (III):

$$[R_1-COO\leftarrow CH_2\rightarrow_n]_a-C\leftarrow(CH_2\rightarrow_m OCO-R_2]_b, \quad (I)$$

wherein a and b each are an integer of 0–4 with the proviso that a+b=4; $R_1$ and $R_2$ independently denote an organic group having 1–40 carbon atoms with the proviso that a difference in carbon number between $R_1$ and $R_2$ is at least 10; and n and m each are an integer of 0–15 with the proviso that n and m are not 0 simultaneously.

$$[R_1-COO\leftarrow CH_2\rightarrow_n]_a-C\leftarrow(CH_2\rightarrow_m OH]_b, \quad (II)$$

wherein a and b each are an integer of 0–4 with the proviso that a+b=4; $R_1$ denotes an organic group having 1–40 carbon atoms; and n and m each are an integer of 0–15 with the proviso that n and m are not 0 simultaneously.

$$[R_1-COO\leftarrow CH_2\rightarrow_n]_a-\overset{\overset{R_3}{|}}{C}\leftarrow(CH_2\rightarrow_m OCO-R_2]_b, \quad (III)$$

wherein a and b each are an integer of 0.3 with the proviso that a+b=3; $R_1$ and $R_2$ independently denote an organic group having 1–40 carbon atoms with the proviso that a difference in carbon number between $R_1$ and $R_2$ is at least 10; $R_3$ denotes an organic group having at least one carbon atom; and n and m each are an integer of 0–15 with the proviso that n and m are not 0 simultaneously.

Specific and non-exhaustive examples of the ester wax of the formulae (I), (II) and (III) may include those represented by the following structural formulae.

| Ex. Wax. No. | Structural Formula |
|---|---|
| (1) | 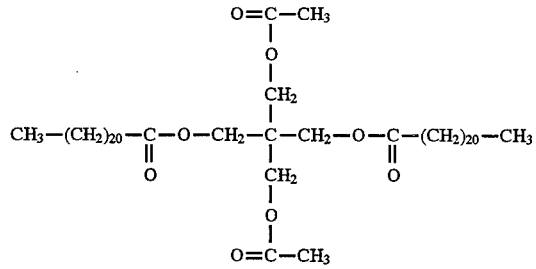 |
| (2) | 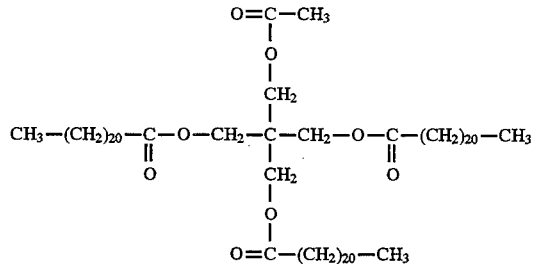 |
| (3) | 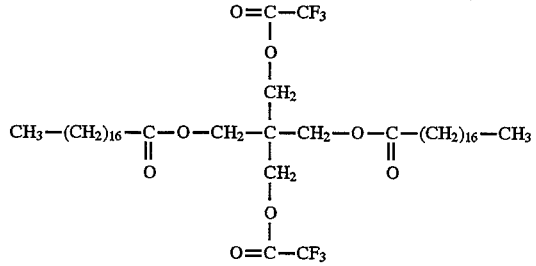 |
| (4) | 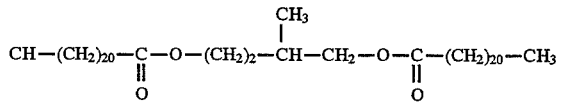 |

The hardness of the ester wax may be measured by using, e.g., a dynamic ultra-minute hardness meter ("DUH-200", available from Shimazu Seisakusho K.K.) in the following manner. An ester wax is melted and molded into a 5 mm-thick cylindrical pellet in a 20 mm dia-mold. The sample is pressed by a Vickers pressure element at a load of 0.5 g and a loading rate of 9.67 mm/sec to cause a displacement of 10 μm, followed by holding for 15 sec. Then, the pressed mark on the sample is analyzed to measure a Vickers hardness. The ester wax used in the present invention may preferably have a Vickers hardness in the range of 0.5–5.0.

In case where the low-softening point substance has a (Vickers) hardness below 0.5, a fixation device used in the present invention has large pressure-dependent properties and large process speed-dependent properties, thus resulting in a poor high-temperature anti-offset characteristic. On the other hand, if the low-softening point substance has a hardness in excess of 5.0, the resultant toner particle have a poor storage stability and the low-softening point substance per se is lowered in its self-cohesive force, thus being insufficient in a high-temperature anti-offset characteristic similarly as in the case of the hardness below 0.5.

In recent years, full-color double-side toner images have been required. In the case of forming such a double-side toner images, transfer-receiving material having a toner image formed on one of the surfaces thereof through a fixation step is again passed through a heated region of a fixing device at the time of forming a toner image on the other surface thereof, so that it is required to take a high-temperature offset characteristic of toner particles into account in particular. For this reason, an additive amount of the low-softening point substance is an important factor in the present invention. More specifically, the low-softening point substance may preferably be contained in the toner particles in an amount of 5–30 wt. %. If the addition amount is below 5 wt. %, a high-temperature anti-offset characteristic of the toner particles is lowered and a toner image formed on the back side of the transfer-receiving material is liable to cause an offset phenomenon at the time of fixing both-side toner images. If the addition amount is in excess of 30 wt. %, toner sticking is liable to occur in a production apparatus when toner particles are produced by, e.g., pulverization method, and in polymerization method, coalescence of toner particles is liable to occur at the time of forming a particle, thus being liable to provide a wider particle size distribution of the resultant toner particles.

The toner particles used in the present invention can be produced by various methods including:

(i) pulverization method: a toner composition comprising a resin, a low-softening point substance as a release agent, a colorant, a charge control agent, etc. is uniformly dispersed by a dispersing device such as a pressure kneader or an extruder and finely pulverized so as to have a desired toner particle size by effecting impingement of the toner composition against a target by the action of mechanical force or jet air stream, optionally is subjected to smoothing treatment or sphering treatment if necessary, and classified to obtain toner particles having a sharp particle size distribution, (ii) melt-spraying method: a melt mixture of toner ingredients is sprayed in the air by using a disk or a fluidic multi-nozzle to obtain spherical toner particles (as disclosed in Japanese Patent Publication (JP-B) 56-13945), and (ii) direct polymerization as follows:

(a) suspension polymerization as disclosed in JP-B 36-10231, JP-A 59-53856, and JP-A 59-61842, (b) dispersion polymerization wherein an aqueous organic solvent in which a monomer is soluble but a polymer is insoluble is used to directly obtain toner particles, and (c) emulsion polymerization such as soap-free polymerization wherein a polymerizable monomer composition is polymerized in the presence of a water-soluble polar polymerization initiator to obtain toner particles.

Among the above production methods, it is difficult to provide the resultant toner particles with an SF-1 of 100–150 by the pulverization method. In the melt-spraying method, it is possible to provide an SF-1 in an appropriate range but the resultant toner particles is liable to have a wider particle size distribution. In the dispersion polymerization, the resultant toner particles show a very sharp particle size distribution but the production apparatus is liable to be complicated in view of a narrow latitude in selecting material used, waste solvent disposal and flammability of the solvent used. The emulsion polymerization or soap-free polymerization is effective in providing a relatively uniform particle size distribution but is liable to worsen an environmental characteristics due to the presence of the emulsifying agent or polymerization initiator at the surface of the toner particles.

Accordingly, the suspension polymerization under normal pressure or application of pressure may preferably be used in the present invention because an SF-1 of the resultant toner particles can readily be controlled in a range of 100–150 and fine toner particles having a sharp particle size distribution and a weight-average particle size of 4–8 μm can be obtained relatively easily. In the present invention, it is also possible to suitably use seed polymerization wherein polymerization particles once obtained are adsorbed by a polymerizable monomer and are polymerized by using a polymerization initiator.

The toner particles used in the present invention may preferably have the following features in combination:

(i) an SF-1 of 100–150 (more preferably 100–125, particularly 100–110), (ii) a core-shell structure wherein a low-softening point substance is enclosed by an outer resin when a cross-section of a toner particle is observed through a transmission electron microscope (TEM).

Such toner particles can be produced directly by the suspension polymerization.

In order to include a large amount of low-softening point substance in the toner particles in view of fixability, the low-softening point substance is required to be enclosed by an outer resin to constitute the respective toner particles. In the case of the toner particles in which the low-softening point substance is not enclosed by the outer resin is used, a sufficient fine pulverization is not effected unless a particular freezing pulverization is utilized in a pulverization step, thus resulting in a broad particle size distribution and causing toner sticking onto the pulverizing device. In the freezing pulverization, the pulverizing device is complicated in order to prevent moisture condensation in the device and causes a lowering in operation characteristics of the toner particles if the toner particles absorb moisture, thus requiring an additional drying step. A specific method of enclosing the low-softening point substance in the outer resin may be performed by setting a polarity in an aqueous medium of a low-softening point substance lower than that of a principal monomer component and adding a small amount of a resin or a monomer having a larger polarity to the above system to form toner particles having a core-shell structure comprising the low-softening point substance enclosed by the outer resin. In this instance, control of a particle size distribution or a particle size of the toner particles may be performed by changing an inorganic salt having little water-soluble characteristic or a dispersant functioning as a protective colloid and the addition amount thereof or controlling mechanical apparatus conditions, such as a peripheral speed of a rotor, number of pass, stirring conditions (e.g., stirring blade shape) and a shape of a reaction vessel, or the solid content in the aqueous medium. As a result, it is possible to obtain toner particles having a prescribed particle size (distribution).

In the present invention, the cross-section observation of the toner particles through the TEM may be performed as follows.

Sample toner particles are sufficiently dispersed in a cold-setting epoxy resin and are solidified or hardened for 2 days at 40° C. The resultant hardened product are dyed with triruthenium tetraoxide and optionally with triosmium tetraoxide in combination, as desired, and cut out in the form of a thin film by a microtome having diamond teeth. The resultant thin film of the sample toner particles is subjected to observation through the TEM. In the present invention, the dyeing method using triruthenium tetraoxide may preferably be used in order to provide a contrast between the low-softening point substance and the outer resin by utilizing a difference in crystallinity therebetween. A typical cross-section of toner particles is shown in FIG. 2. In toner particles prepared in the examples appearing hereinbelow, it was confirmed that the low-softening point substance was enclosed in the outer resin.

In the present invention, examples of the binder resin may include various resins as generally used, such as styrene-(meth)acrylate copolymer, polyester resin, epoxy resin and styrene-butadiene copolymer.

In the case of directly producing the toner through the polymerization process, the monomer may be a vinyl-type monomer, examples of which may include: styrene and its derivatives such as styrene, o-, m- or p-methylstyrene, and m- or p-ethylstyrene; (meth)acrylic acid esters such as methyl (meth)acrylate, ethyl (meth)acrylate, propyl (meth) acrylate, butyl (meth)acrylate, octyl (meth)acrylate, dodecyl (meth)acrylate, 2-ethylhexyl (meth)acrylate, stearyl (meth) acrylate, behenyl (meth)acrylate, dimethylaminoethyl (meth)acrylate, and diethylaminoethyl (meth)acrylate; butadiene; isoprene; cyclohexene; (meth)acrylonitrile, and acrylamide. These monomers may be used singly or in mixture of two or more species.

The above monomers may preferably have a theoretical glass transition point (Tg), described in "POLYMER HANDBOOK", second addition, III-pp. 139–192 (available from John Wiley & Sons Co.), of 40°–75° C. as it is or in mixture. If the theoretical glass transition point is below 40° C., the resultant toner particles are lowered in storage stability and durability. On the other hand, the theoretical glass transition point is in excess of 75° C., the fixation temperature of the toner particles is increased, whereby respective color toner particles have an insufficient color-mixing characteristic in the case of the full-color image formation in particular. As a result, the resultant toner particles have a poor color reproducibility and undesirably lower a transparency of an OHP image.

In the present invention, the molecular-weight distribution of the binder resin may be measured by gel permeation chromatography (GPC) as follows.

In the case of toner particles having a core-shell structure, the toner particles are subjected to extraction with toluene for 20 hours by means of Soxhlet extractor in advance, followed by distilling-off of the solvent (toluene) to obtain an extract. An organic solvent (e.g.,chloroform) in which a low-softening point substance is dissolved and an outer resin is not dissolved is added to the extract and sufficiently washed therewith to obtain a residue product. The residue product is dissolved in tetrahydrofuran (THF) and subjected to filtration with a solvent-resistance membrane filter having a pore size of 0.3 μm to obtain a sample solution (THF solution) The sample solution is injected in a GPC apparatus ("GPC-150C", available from Waters Co.) using columns of A-801, 802, 803, 804, 805, 806 and 807 (manufactured by Showa Denko K.K.) in combination. The identification of sample molecular weight and its molecular weight distribution is performed based on a calibration curve obtained by using monodisperse polystyrene standard samples. In the present invention, the binder resin may preferably have a number-average particle size (Mn) of 5,000–1,000,000 and a ratio of weight-average particle size (Mw) to Mn (Mw/Mn) of 2–100.

In order to enclose the low-softening point substance in the outer resin (layer), it is particularly preferred to add a polar resin. Preferred examples of such a polar resin may include styrene-(meth)acrylate copolymer, maleic acid-based copolymer, unsaturated polyester resin, saturated polyester resin and epoxy resin. The polar resin may particularly preferably have no unsaturated group capable of reacting with the outer resin or a vinyl monomer constituting the outer resin. This is because if the polar resin has an unsaturated group, the unsaturated group causes crosslinking reaction with the vinyl monomer, thus resulting in an outer resin having a very high molecular weight. As a result, such a polar resin has the disadvantage of a poor color-mixing characteristic with respect to four color toners for full-color image formation.

The colorant used in the present invention may include a black colorant, yellow colorant, a magenta colorant and a cyan colorant.

Examples of the black colorant may include: carbon black, a magnetic material, and a colorant showing black by color-mixing of yellow/magenta/cyan colorants.

Examples of the yellow colorant may include: condensed azo compounds, isoindolinone compounds, anthraquinone compounds, azo metal complexes, methin compounds and arylamide compounds. Specific preferred examples thereof may include C.I. Pigment Yellow 12, 13, 14, 15, 17, 62, 74, 83, 93, 94, 95, 109, 110, 111, 128, 129, 147, 168 and 180.

Examples of the magenta colorant may include: condensed azo compounds, diketopyrrolpyrrole compounds, anthraquinone compounds, quinacridone compounds, basis dye lake compounds, naphthol compounds, benzimidazole compounds, thioindigo compounds an perylene compounds. Specific preferred examples thereof may include: C.I. Pigment. Red 2, 3, 5, 6, 7, 23, 48:2, 48:3, 48:4, 57:1, 81:1, 144, 146, 166, 169, 177, 184, 185, 202, 206, 220, 221 and 254.

Examples of the cyan colorant may include: copper phthalocyanine compounds and their derivatives, anthraquinone compounds and basis dye lake compounds. Specific preferred examples thereof may include: C.I. Pigment Blue 1, 7, 15, 15:1, 15:2, 15:3, 15:4, 60, 62, and 66.

These colorants may be used singly, in mixture of two or more species or in a state of solid solution. The above colorants may be appropriately selected in view of hue, color saturation, color value, weather resistance, OHP transparency, and a dispersibility in toner particles. The above colorants except for the black colorant may preferably be used in a proportion of 1–20 wt. parts per 100 wt. parts of the binder resin. The black colorant may preferably be used in a proportion of 40–150 wt. parts per 100 wt. parts of the binder resin.

The charge control agent used in the present invention may include known charge control agents. The charge control agent may preferably be one being colorless and having a higher charging speed and a property capable of stably retaining a prescribed charge amount. In the case of using the direct polymerization for producing the toner particles of the present invention, the charge control agent may particularly preferably be one free from polymerization-inhibiting properties and not containing a component soluble in an aqueous medium.

The charge control agent used in the present invention may be those of negative-type or positive-type. Specific examples of the negative charge control agent may include: metal-containing acid-based compounds comprising acids such as salicylic acid, naphtoic acid, and dicarboxylic acid; polymeric compounds having a side chain comprising sulfonic acid or carboxylic acid; boron compound; urea compounds; silicon compound; and calixarene. Specific examples of the positive charge control agent may include: quarternary ammonium salts; polymeric compounds having a side chain comprising quarternary ammonium salts; guanidine compounds; and imidazole compounds.

The charge control agent used in the present invention may preferably be used in a proportion of 0.5–10 wt. parts per 100 wt. parts of the binder resin.

However, the charge control agent is not an essential component for the toner particles used in the present invention. The charge control agent can be used as an optional additive in some cases. In the case of using two-component developing method, it is possible to utilize triboelectric charge with a carrier. In the case of using a non-magnetic one-component blade coating developing method, it is aggressively utilize triboelectric charge with a blade member or a sleeve member.

Examples of the polymerization initiator usable in the direct polymerization may include: azo-or diazo-type polymerization initiators, such as 2,2'- azobis-(2,4-dimethylvaleronitrile), 2,2'-azobisisobutylonitrile, 1,1'-azobis(cyclohexane-2-carbonitrile), 2,2'-azobis-4-methoxy-2,4-dimethylvaleronitrile, azobisisobutyronitrile; and peroxide-type polymerization initiators such as benzoyl peroxide, methyl ethyl ketone peroxide, diisopropyl peroxycarbonate, cumene hydroperoxide, 2,4-dichlorobenzoyl peroxide, and lauroyl peroxide. The addition amount of the polymerization initiator varies depending on a polymerization degree to be attained. The polymerization initiator may generally be used in the range of about 0.5–20 wt. % based on the weight of the polymerizable monomer. The polymerization initiators somewhat vary depending on the polymerization process used and may be used singly or in mixture while making reference to 10-hour half-life period temperature.

In order to control the molecular weight of the resultant binder resin, it is also possible to add a crosslinking agent, a chain transfer agent, a polymerization inhibitor, etc.

In production of the polymerization toner particles by the suspension polymerization using a dispersion stabilizer, it is preferred to use an inorganic or/and an organic dispersion stabilizer in an aqueous dispersion medium. Examples of the inorganic dispersion stabilizer may include: tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of the organic dispersion stabilizer may include: polyvinyl alcohol, gelatin, methyl cellulose, methyl hydroxypropyl cellulose, ethyl cellulose, carboxymethyl cellulose sodium salt, polyacrylic acid and its salt and starch. These dispersion stabilizers may preferably be used in the aqueous dispersion medium in an amount of 0.2–20 wt. parts per 100 wt. parts of the polymerizable monomer mixture.

In the case of using an inorganic dispersion stabilizer, a commercially available product can be used as it is, but it is also possible to form the stabilizer in situ in the dispersion medium so as to obtain fine particles thereof. In the case of tricalcium phosphate, for example, it is adequate to blend an aqueous sodium phosphate solution and an aqueous calcium chloride solution under an intensive stirring to produce tricalcium phosphate particles in the aqueous medium.

In order to effect fine dispersion of the dispersion stabilizer, it is also effective to use 0.001–0.1 wt. % of a surfactant in combination, thereby promoting the prescribed function of the stabilizer. Examples of the surfactant may include: sodium dodecylbenzenesulfonate, sodium tetradecyl sulfate, sodium pentadecyl sulfate, sodium octyl sulfate, sodium oleate, sodium laurate, potassium stearate, and calcium oleate.

The toner particles according to the present invention may also be produced by direct polymerization in the following manner. Into a polymerizable monomer, a releasing agent comprising the low-softening point substance, a colorant, a charge control agent, a polymerization initiator and another optional additive are added and uniformly dissolved or dispersed by a homogenizer or an ultrasonic dispersing device, to form a polymerizable monomer composition, which is then dispersed and formed into particles in a dispersion medium containing a dispersion stabilizer by means of a stirrer, homomixer or homogenizer preferably under such a condition that droplets of the polymerizable monomer composition can have a desired particle size of the resultant toner particles by controlling stirring speed and/or stirring time. Thereafter, the stirring may be continued in such a degree as to retain the particles of the polymerizable monomer composition thus formed and prevent the sedimentation of the particles. The polymerization may be performed at a temperature of at least 40° C., generally 50°–90° C. The temperature can be raised at a latter stage of the polymerization. It is also possible to subject a part of the aqueous system to distillation in a latter stage of or after the polymerization in order to remove the yet-polymerized part of the polymerizable monomer and a by-product which can cause an oder in the toner fixation step. After the reaction, the produced toner particles are washed, filtered out, and dried. In the suspension polymerization, it is generally preferred to use 300–3000 wt. parts of water as the dispersion medium per 100 wt. parts of the monomer composition.

Hereinbelow, the image forming method according to the present invention will be explained specifically with reference to FIG. 1.

Figure 1:
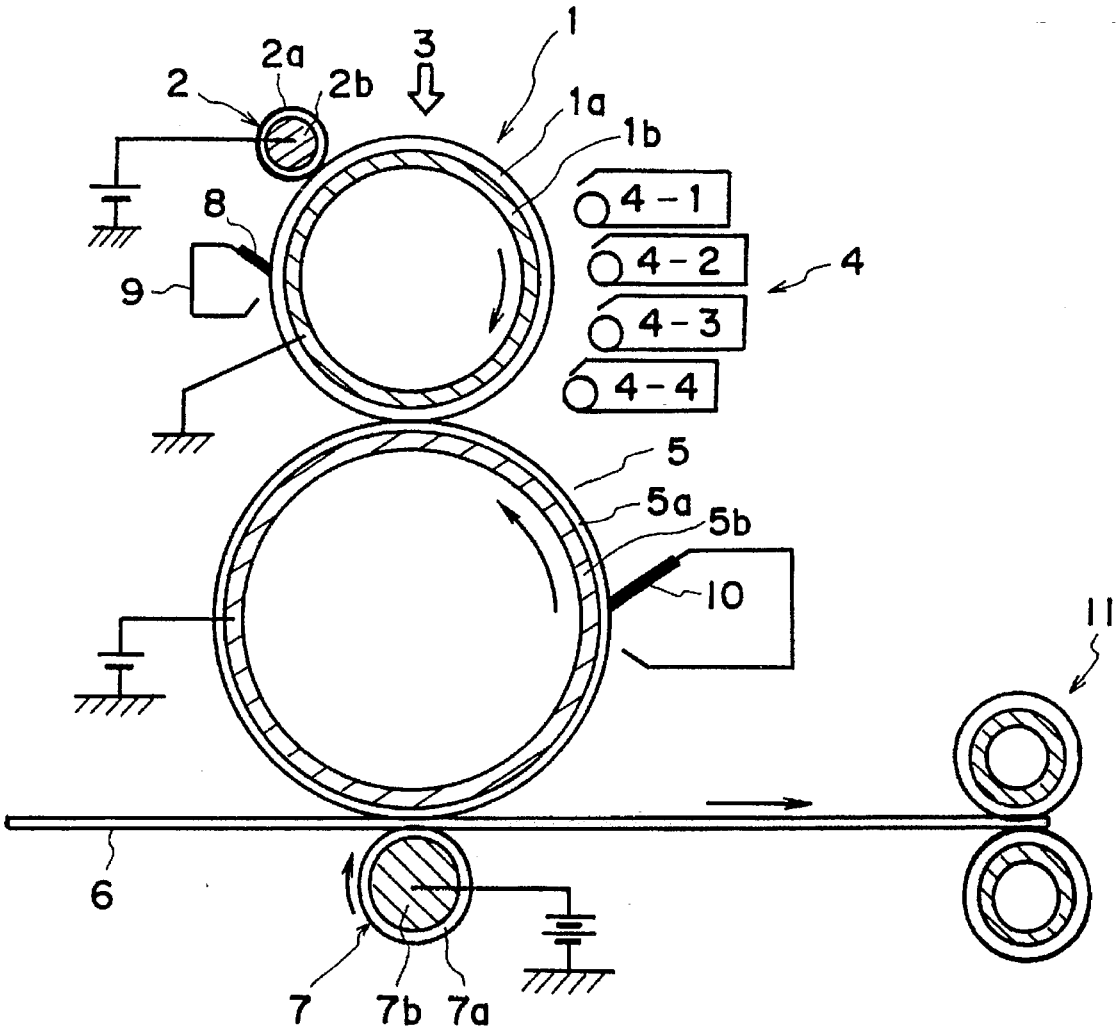
FIG. 1 is a schematic sectional view of an embodiment of an image forming apparatus suitable for image forming method according to the present invention.

Referring to FIG. 1, an image forming apparatus principally includes a photosensitive member 1 as an electrostatic image-bearing member, a charging roller 2 as a charging means, a developing device 4 comprising four developing units 4-1, 4-2, 4-3 and 4-4, an intermediate transfer member 5, a transfer roller 7 as a transfer means, and a fixing device 11 as a fixing means.

Four developers comprising cyan toner particles, magenta toner particles, yellow toner particles, and black toner particles are incorporated in the developing units 4-1 to 4-4. An electrostatic image is formed on the photosensitive member 1 and developed with the four color toner particles by a developing method such as a magnetic brush developing system or a non-magnetic monocomponent developing system, whereby the respective toner images are formed on the photosensitive member 1. The photoconductive member 1 comprises a support 1*a* and a photosensitive layer 1*b* thereon comprising a photoconductive insulating substance such as α-Si, CdS, $ZnO_2$, OPC (organic photoconductor), and α-Si (amorphous silicon). The photosensitive member 1 may preferably comprise an α-Si photosensitive layer or OPC photosensitive layer. The photosensitive member 1 is rotated in a direction of an arrow by a drive mean (not shown).

The organic photosensitive layer may be composed of a single layer comprising a charge-generating substance and a charge-transporting substance or may be function-separation type photosensitive layer comprising a charge generation layer and a charge transport layer. The function-separation type photosensitive layer may preferably comprise an electroconductive support, a charge generation layer, and a charge transport layer arranged in this order. The organic photosensitive layer may preferably comprise a binder resin such as polycarbonate resin, polyester resin or acrylic resin because such a binder resin is effective in improving transferability and cleaning characteristic and little cause toner sticking onto the photosensitive member and filming of external additives.

In the present invention, a charging step may be performed by non-contact charging using a corona charger which is not in contact with the photosensitive member 1 or by contact charging using, e.g., a charging roller. The contact charging as shown in FIG. 1 may preferably be used in view of efficiently uniform charging, simplification and a lowering in ozone. The charging roller 2 comprises a core metal 2*b* and an electroconductive elastic layer 2*a* surrounding a periphery of the core metal 2*b*. The charging roller 2 is pressed against the photosensitive member 1 at a prescribed pressure (pressing force) and rotated while being mated with the rotation of the photosensitive member 1.

The charging step using the charging roller may preferably performed under process conditions including an applied pressure of the roller of 5–500 g/cm, an AC voltage of 0.5–5 kVpp, an AC frequency of 50-5 kHz and a DC voltage of ±0.2–±1.5 kV in the case of applying superposed voltage of AC voltage and DC voltage; and an applied pressure of the roller of 5–500 g/cm and a DC voltage of ±0.2–±1.5 kV in the case of applying DC voltage.

Other charging means may include those using a charging blade or an electroconductive brush. These contact charging means are effective in omitting a high voltage or decreasing in occurrence of ozone. The charging roller and charging blade each used as the contact charging means may preferably comprise an electroconductive rubber and may optionally comprise a releasing film on the surface thereof. The releasing film may preferably comprise a nylon-based resin, polyvinylindene fluoride (PVDF) or polyvinylindene chloride (PVDC).

The toner image formed on the photosensitive member is transferred to the intermediate transfer member 5 to which a voltage (e.g., ±0.1–±5 kV) is applied. The intermediate transfer member 5 comprises a pipe-like electroconductive core metal 5*b* and a medium resistance-elastic layer 5*a* (e.g., an elastic roller) surrounding a periphery of the core metal 5*b*. The core metal 5*b* may be one comprising a plastic pipe which has been subjected to electroconductive plating. The medium resistance-elastic layer 5*a* may be a solid layer or a foamed material layer in which an electroconductivity-imparting substance such as carbon black, zinc oxide, tin oxide or silicon carbide is mixed and dispersed in an elastic material such as silicone rubber, teflon rubber, chloroprene rubber, urethane rubber or ethylene-propylene-diene terpolymer (EPDM) so as to control an electric resistance or a volume resistivity at a medium resistance level of $10^5$–$10^{11}$ ohm.cm, particularly $10^7$–$10^{10}$ ohm.cm. The intermediate transfer member 5 is disposed under the photosensitive member 1 so that it has an axis (or a shaft) disposed in parallel with that of the photosensitive member 1 and is in contact with the photosensitive member 1. The intermediate transfer member 5 is rotated in the direction of an arrow (counterclockwise direction) at a peripheral speed identical to that of the photosensitive member 1.

The respective color toner images are successively intermediately transferred to the peripheral surface of the intermediate transfer member 5 by an elastic field formed by applying a transfer bias to a transfer nip region between the photosensitive member 1 and the intermediate transfer member 5 at the time of passing through the transfer nip region.

After the intermediate transfer of the respective toner image, the surface of the intermediate transfer member 5 is cleaned, as desired, by a cleaning means 10 which can be attached to or detached from the image forming apparatus. In case where the toner image is placed on the intermediate transfer member 5, the cleaning means 5 is detached or released from the surface of the intermediate transfer member 5 so as not to damage the toner image.

The transfer means (e.g., a transfer roller) 7 is disposed under the intermediate transfer member 5 so that it has an axis (or a shaft) disposed in parallel with that of the intermediate transfer member 5 and is in contact with the intermediate transfer member 5. The transfer means (roller) 7 is rotated in the direction of an arrow (clockwise direction) at a peripheral speed identical to that of the intermediate transfer member 5. The transfer roller 7 may be disposed so that it is directly in contact with the intermediate transfer member 5 or in contact with the intermediate transfer member 5 by the medium of a belt, etc. The transfer roller 7 may be constituted by disposing an electroconductive elastic layer 7*a* on a peripheral surface of a core metal 7*b*.

The intermediate transfer member 5 and the transfer roller 7 may comprise known materials as generally used. In the present invention, by setting a volume resistivity of the elastic layer 5*a* of the intermediate transfer member 5 higher than that of the elastic layer 7*b* of the transfer, it is possible to alleviate a voltage applied to the transfer roller 7. As a result, a good toner image is formed on the transfer-receiving material and the transfer-receiving material is prevented from winding about the intermediate transfer member 5. The elastic layer 5*a* of the intermediate transfer member 5 may preferably has a volume resistivity at least ten times higher than that of the elastic layer 7*b* of the transfer roller 7.

The intermediate transfer member 5 may preferably comprise the elastic layer 5*a* having a hardness of 10–40 as measured by JIS K-6301. On the other hand, the transfer roller 7 may preferably comprise an elastic layer 7*a* having a hardness higher than that of the elastic layer 5*a* of the intermediate transfer member 5, more preferably a hardness of 41–80 as measured by JIS K-6301 for preventing the transfer-receiving material from winding about the intermediate transfer member 5. If the hardness of the elastic layer 7*a* of the transfer roller 7 is lower than that of the elastic layer 5*a* of the intermediate transfer member 5, a concavity (or a recess) is formed on the transfer roller side, thus being liable to cause the winding of the transfer-receiving material about the intermediate transfer member 5.

The transfer roller 7 may be rotated at the same or different peripheral speed as that of the intermediate transfer member 5. The transfer-receiving material 6 is conveyed to a nip, between the intermediate transfer member 5 and the transfer roller 7, at which a toner image on the intermediate transfer member 5 is transferred to the front surface of the transfer-receiving material 6 by applying a transfer bias having a polarity opposite to that of triboelectric charge of the toner particles to the transfer roller 7.

The transfer roller 7 may comprise materials similar to those constituting the charging roller 2. The transfer step may be performed under conditions including a pressure of the transfer roller of 5–500 g/cm and a DC voltage of ±0.2–±10 kV. More specifically, the transfer roller 7 comprise a core metal **7*b* and an electroconductive elastic layer 7*a* comprising an elastic material having a volume resistivity of $10^6$–$10^{10}$ ohm.cm, such as polyurethane or ethylene-propylene-diene terpolymer (EPDM) containing an electroconductive substance, such as carbon, dispersed therein. A certain bias voltage (e.g., preferably of ±0.2–±10 kV) is applied to the core metal 7*b*** by a constant-voltage supply.

The transfer-receiving material 6 is then conveyed to the fixing device 11 comprising two rollers including a heated roller enclosing a heating member (e.g., a halogen heater) and a pressure roller pressed against the heated roller at a prescribed pressure. The toner image on the transfer-receiving material 6 is passed between the heated roller and the pressure roller to fix the toner image on the transfer-receiving material 6 under application of heat and pressure. The fixing step may also be performed by applying heat to the toner image by the medium of a film by a heater.

After the transfer of the color toner images from the intermediate transfer member 5 to the transfer-receiving material 6, residual toner particles on the transfer roller 7 may be cleaned by a cleaning member such as a fur-brush cleaner. In the present invention, a higher transfer efficiency (transfer ratio) can be attained by using the toner particles having an SF-1 of 100–150 (preferably 100–125, particularly 100–110), so that a cleaning member-less system may also be applied.

Herein, a transfer ratio (or transfer rate) ($T_1$) of a toner image from the electrostatic image-bearing member to the intermediate transfer member may be measured as follows.

A toner image (image density of about 1.5) formed on the electrostatic image-bearing member (photosensitive member) is recovered by a transparent adhesive tape and subjected to measurement of an image density ($d_1$) by a Macbeth densitometer or a color reflection densitometer (e.g., "Color reflection densitometer X-RITE 404A", manufactured by X-Rite Co.). Then, a toner image is again formed on the electrostatic image-bearing member and intermediately transferred to the intermediate transfer member. The toner image on the intermediate transfer member corresponding to that of the above-recovered toner image is also recovered by a transfer adhesive tape and subjected to measurement of an image density ($d_2$) similarly as in the case of the toner image recovered from the electrostatic image-bearing member.

The transfer ratio ($T_1$ (%)) from the electrostatic image-bearing member to the intermediate transfer member is defined by the following equation:

$$T_1(\%)=(d_2/d_1)\times 100.$$

Similarly, a transfer ratio ($T_2$) of a toner image from the intermediate transfer member to the transfer-receiving material is defined by the following equation:

$$T_2(\%)=(d_3/d_2)\times 100,$$

wherein $d_3$ denotes an image density of the toner image recovered from the transfer-receiving material.

An overall transfer ratio ($T_{overall}$) is defined by the following equation:

$$T_{overall}(\%)=(T_1/100)\times(T_2/100)\times 100.$$

Hereinbelow, the present invention will be explained more specifically with reference to Examples and Comparative Examples.

Example 1

FIG. 1 shows a schematic sectional view of an image forming apparatus used in this example.

Referring to FIG. 1, a photosensitive member 1 comprising a support **1*a* and a photosensitive layer 1*b* disposed thereon containing an organic photosemiconductor was rotated in the direction of an arrow and charged so as to have a surface potential of about −600 V by a charging roller 2 (comprising an electroconductive elastic layer 2*a* and a core metal 2*b*). An electrostatic image having a light (exposure) part potential of −100 V and a dark part potential of −600 V was formed on the photosensitive member 1 by exposing the photosensitive member 1 to light-image 3 by using an image exposure means effecting ON and OFF based on digital image information through a polygonal mirror. The electrostatic image was developed with yellow toner particles, magenta toner particles, cyan toner particles or black toner particles contained in plural developing units 4-1 to 4-4 by using reversal development to form color toner images on the photosensitive member 1. Each of the color toner images was transferred to a intermediate transfer member 5 (comprising an elastic layer 5*a* and a core metal 5*b* as a support) to form thereon a superposed four-color image. Residual toner particles on the photosensitive member 1 after the transfer are recovered by a cleaning member 8 to be contained in a residual toner container 9**. This cleaning step can be performed by a simple bias roller or by not using the cleaning member without causing a problem since sphere-shaped toner particles used in the present invention provides a higher transfer efficiency than irregular-shaped toner particles.

The intermediate transfer member 5 was formed by applying a coating liquid for the elastic layer **5*a* comprising carbon black (as an electroconductivity-imparting material) sufficiently dispersed in acrylonitrile-butadiene rubber (NBR) onto a pipe-like core metal 5*b*. The elastic layer 5*a* of the intermediate transfer member 5 showed a hardness of 30 as measured by JIS K-6301 and a volume resistivity of $10^9$ ohm.cm. The transfer from the photosensitive member 1 to the intermediate transfer member 5 was performed by applying a voltage of +500 V from a power supply to the core metal 5*b*** to provide a necessary transfer current of about 5 μA.

The superposed four-color image was then transferred to a transfer-receiving material 6 by using a transfer roller 7 having a diameter of 20 mm. The transfer roller 7 was formed by applying a coating liquid for the elastic layer **7*a* comprising carbon (as an electroconductivity-imparting material) sufficiently dispersed in a foamed ethylenepropylenediene terpolymer (EPDM) onto a 10 mm dia.-core metal 7*b*. The electrostatic layer 7*a* of the transfer roller 7 showed a hardness of 35 as measured by JIS K-6301 and a volume resistivity of $10^6$ ohm.cm. The transfer from the intermediate transfer member 5 to the transfer-receiving material 6 was performed by applying a voltage to the transfer roller 7** to provide a transfer current of 15 μA.

Cyan toner particles used in this example were prepared in the following manner.

Into 2 liter-four necked flask equipped with a high-speed stirring device ("TK homomixer", mfd. by Tokushu Kika Kogyo K.K.), 710 wt. parts of deionized water and 450 wt. parts of 0.1M-$Na_3PO_4$ were added. The mixture was stirred at 12000 rpm and warmed at 65° C. Further, 68 wt. parts of 1.0M-$CaCl_2$ aqueous solution was added thereto form to an aqueous dispersion medium containing $Ca_3(PO_4)_2$ (fine dispersion stabilizer with little water-solubility).

Styrene 165 wt. parts n-Butyl acrylate 35 wt. parts

Cyan colorant 14 wt. parts (C.I. Pigment Blue 15:3)

Polar resin 10 wt. parts (saturated polyester (terephthalic acid-propylene oxide modified bisphenol A, acid value=15, peak molecular weight (GPC)=6000))

Charge control agent 2 wt. parts (metal-containing salicylic acid compound)

Low softening point substance 60 wt. parts (ester wax (Ex. wax. No. (1))

The above ingredients were dispersed for 3 hours by an attritor. Into the mixture, 10 wt. parts of 2,2'-azobis(2,4-dimethylvaleronitrile) (polymerization initiator) was added, whereby a polymerizable monomer composition was prepared. The polymerizable monomer composition was added into the above aqueous dispersion medium and stirred at 12000 rpm for 15 minutes by the high-speed stirring device to disperse the polymerizable monomer composition into particles. The mixture was warmed at 80° C. and stirred at 50 rpm for 10 hours by a propeller blade stirring device to complete polymerization. After the polymerization, the resultant slurry was cooled, followed by addition of dilute hydrochloric acid to remove the dispersion stabilizer, washing and drying to recover electrical insulating cyan toner particles having a weight-average particle sizes (Dw) of 6 μm, a coefficient of variation in number (A) of 28%, an SF-1 of 105 and an SF-2 of 109.

The cyan toner particles were subjected to observation of cross-section thereof through a transmission electron microscope (TEM). The cross-section of the cyan toner particles showed a core-shell structure (as schematically illustrated in FIG. 2) in which the ester wax (Ex. wax No. (1)) (low-softening point substance) was covered with an outer resin (weight-average molecular weight (Mw) of 70,000 and number-average molecular weight (Mn) of 20,000).

To the cyan toner particles, 2 wt. % of hydrophobic titanium oxide fine particles were externally added to obtain (electrical insulating) cyan toner particles excellent in fluidity.

6 wt. parts of the resultant cyan toner particles (containing hydrophobic titanium oxide fine particles) and 94 wt. parts of a resin-coated magnetic ferrite carrier having an average particle size of 50 μm were blended to prepare a two-component developer.

Electrical insulating yellow toner particles, electrical insulating magenta toner particles and electrical insulating black toner particles were prepared in the same manner as in the case of the cyan toner particles except that the cyan colorant (C.I. Pigment Blue 15:3) was changed to C.I. Pigment Yellow 17, C.I. Pigment Red 202 and grafted carbon black, respectively.

The thus-prepared four color toner particles had physical properties shown in Table 1 below.

TABLE 1

| Toner particles | Dw (μm) | A (%) | SF-1 | SF-2 | Outer resin Mw (× $10^4$) | Outer resin Mn (× $10^4$) | Volume resistivity (ohm · cm) |
|---|---|---|---|---|---|---|---|
| Cyan | 6 | 28 | 105 | 109 | 7 | 2 | ≧$10^{14}$ |
| Yellow | 6 | 28 | 105 | 109 | 7 | 2 | ≧$10^{14}$ |
| Magenta | 6 | 28 | 105 | 109 | 7 | 2 | ≧$10^{14}$ |
| Black | 7 | 28 | 105 | 109 | 7 | 2 | ≧$10^{14}$ |

The respective color toner image was formed by a magnetic brush developing method using the respective color two-component developer contained in the respective developing unit (4-1, 4-2, 4-3 or 4-4) shown in FIG. 1 under the image forming conditions described above.

The respective toner particles constituting the respective color image had a triboelectric charge amount of −15 to −18 μC/g.

The transfer step was performed specifically as follows.

The respective toner image formed on the photosensitive member 1 was successively transferred to an intermediate transfer member 5 and further transferred to a transfer-receiving material 6 (plain paper having a basis weight of 199 g/m$^2$) to form a superposed four-color toner image on the transfer-receiving material 6. After each of the above transfer of the color toner images from the intermediate transfer member 5 to the transfer-receiving material 6, the surface of the intermediate transfer member 5 was successively cleaned by a cleaning member 10.

The transferred superposed four-color toner image was subjected to heat fixation by using a fixing means 10 utilizing application of heat and pressure.

Each of the thus formed four color toner images showed a high transfer efficiency including a transfer ratio ($T_1$) (from the photosensitive member to the intermediate transfer member) of 95–98%, a transfer ratio ($T_2$) (from the intermediate transfer member to the transfer-receiving material) of 99%, and an overall transfer ratio ($T_{overall}$) (from the photosensitive member to the transfer-receiving material through the intermediate transfer member) of 94.1–97.0%. The resultant toner image was also excellent in color-mixing characteristic and was a high quality image free from a hollow image.

Further, when double-side image formation was performed, an occurrence of an offset phenomenon on both sides of a transfer-receiving material was not observed.

When a copying test of 50,000 sheets (durability test) was performed, an image density of the resultant image was not changed between at an initial stage and after the durability test and toner sticking onto the respective member of the image forming apparatus was not caused to occur.

Example 2

Cyan toner particles were prepared in the following manner.

Styrene n-butyl acrylate copolymer 200 wt. parts (Mw=70,000; Mn=20,000)

Cyan colorant 14 wt. parts (C.I. Pigment Blue 15:3)

Polar resin 10 wt. parts (saturated polyester (terephthalic acid-propylene oxide modified bisphenol A, acid value=15, peak molecular weight (GPC)=6000))

Charge control agent 2 wt. parts (metal-containing salicylic acid compound)

Low softening point substance 15 wt. parts (ester wax (Ex. wax. No. (1))

The above ingredients were sufficiently melt-kneaded in an extruder, after cooling, was mechanically coarsely crushed. The coarsely crushed product was finely pulverized by effecting impingement of the product against a target under the action of jet air stream and then classified by a pneumatic classifier utilizing Coanda effect to obtain irregular-shaped cyan toner particles (Dw=8 μm, A=29%). The irregular-shaped cyan toner particles were mixed with an appropriate amount of a commercially available calcium phosphate fine powder by a Henschel mixer. The mixture was poured into water placed in a vessel and stirred to disperse the mixture in water by using a homomixer. The dispersion mixture was gradually warmed at 80° C. and further stirred for 3 hours at 80° C. Then, diluted hydrochloric acid was added to the resultant dispersion mixture to sufficiently dissolve calcium phosphate present at the surface of the cyan toner particles. The thus treated cyan toner particles were recovered by filtration, washed, dried and shifted by using a 400 mesh-sieve to remove an agglomerate or aggregate, whereby an electrical insulating cyan toner particles (Dw=7.7 μm, A=28%). The resultant cyan toner particles was subjected to electron microscope observation to show a substantially spherical shape including an SF-1 of 109 and an SF-2 of 120.

Electrical insulating yellow toner particles, electrical insulating magenta toner particles and electrical insulating black toner particles were prepared in the same manner as in the case of the cyan toner particles except that the cyan colorant (C.I. Pigment Blue 15:3) was changed to C.I. Pigment Yellow 17, C.I. Pigment Red 202 and grafted carbon black, respectively (identical to those used in Example 1).

When each of the above-prepared four color toner particles was subjected to cross-section observation in the same manner as in Example 1, a core-shell structure as shown in FIG. 2 was not observed.

The thus-prepared four color toner particles had physical properties shown in Table 2 below.

TABLE 2

| Toner particles | Dw (μm) | A (%) | SF-1 | SF-2 | Volume resistivity (ohm · cm) |
|---|---|---|---|---|---|
| Cyan | 7.7 | 28 | 109 | 120 | $\geqq 10^{14}$ |
| Yellow | 7.5 | 26 | 108 | 120 | $\geqq 10^{14}$ |
| Magenta | 7.6 | 27 | 109 | 120 | $\geqq 10^{14}$ |
| Black | 7.8 | 29 | 110 | 121 | $\geqq 10^{14}$ |

The thus prepared four color toner particles were subjected to image formation by using the image forming apparatus used in Example 1, whereby high-quality toner images excellent in color-mixing characteristic and free from a hollow image. When a durability test (copying of 50,000 sheets) was performed in the same manner as in Example 1, the resultant image showed an image density of 1.6 at (an initial stage) and an image density of 1.5 (after the durability test) which was practically acceptable level. At this time, the four color toner images showed a high transfer efficiency including $T_1$=94–96%, $T_2$=97% and $T_{overall}$=91.2–93.1%.

Comparative Example 1

Cyan toner particles were prepared in the following manner.

Styrene n-butyl acrylate copolymer 200 wt. parts (Mw=70,000; Mn=20,000)

Cyan colorant 14 wt. parts (C.I. Pigment Blue 15:3)

Polar resin 10 wt. parts (saturated polyester (terephthalic acid-propylene oxide modified bisphenol A, acid value=15, peak molecular weight (GPC)=6000))

Charge control agent 2 wt. parts (metal-containing salicylic acid compound)

Low softening point substance 15 wt. parts (ester wax (Ex. wax. No. (1))

The above ingredients were sufficiently melt-kneaded in an extruder, after cooling, was mechanically coarsely crushed. The coarsely crushed product was finely pulverized by effecting impingement of the product against a target under the action of jet air stream and then classified by a pneumatic classifier utilizing Coanda effect to obtain irregular-shaped cyan toner particles (Dw=8.5 μm, A=37%, SF-1=152, SF-2=145).

Electrical insulating yellow toner particles, electrical insulating magenta toner particles and electrical insulating black toner particles were prepared in the same manner as in the case of the cyan toner particles except that the cyan colorant (C.I. Pigment Blue 15:3) was changed to C.I. Pigment Yellow 17, C.I. Pigment Red 202 and grafted carbon black, respectively.

The thus-prepared four color toner particles had physical properties shown in Table 3 below.

TABLE 3

| Toner particles | Dw (μm) | A (%) | SF-1 | SF-2 | Volume resistivity (ohm · cm) |
|---|---|---|---|---|---|
| Cyan | 8.5 | 37 | 152 | 145 | $\geqq 10^{14}$ |
| Yellow | 8.7 | 38 | 154 | 148 | $\geqq 10^{14}$ |
| Magenta | 8.6 | 37 | 153 | 147 | $\geqq 10^{14}$ |
| Black | 8.9 | 39 | 154 | 148 | $\geqq 10^{14}$ |

The thus prepared four color toner particles were subjected to image formation in the same manner as in Example 1, whereby the resultant color toner images showed a poor transfer efficiency including $T_1$=85–87%, $T_2$=90% and $T_{overall}$=76.5–78.3%). When a durability test (copying of 50,000 sheets) was performed in the same manner as in Example 1, the resultant image showed a low image density of 1.06 at (an initial stage) and a low image density of 0.9 (after the durability test) which were not practically acceptable level.

Comparative Example 2

The four color toner particles used in Example 1 were subjected to image formation by using a commercially available full-color copying machine ("CLC-500", manufactured by Canon K.K. ) not using a intermediate transfer member.

In the case of using a transfer-receiving material (basis weight=105 g/m$^2$), a color toner image was successively transferred (4 times) to the transfer-receiving material adsorbed to the surface of a transfer drum with the assistance of a gripper (as an auxiliary means), followed by roller fixation under application of heat and pressure to obtain a high-quality full-color image.

However, in the case of using a transfer-receiving member (basis weight=199 g/m$^2$), partial transfer failure (partially ununiform transfer) due to unevenness in formation of the transfer-receiving material and adsorption failure of the transfer-receiving material to the transfer drum were caused to occur. Further, the back end of the transfer-receiving material also caused adsorption failure to the transfer drum, thus resulting in transfer failure of the toner image to the transfer-receiving material.

Comparative Example 3

Irregular-shaped four color toner particles were respectively prepared in the same manner as in Comparative Example b 1(pulverization method) except that the addition amount (15 wt. parts) of the ester wax (Ex. wax No. (1)) was changed to 9 wt. parts. Each of the four color toner particles showed an SF-1 of 152–155 and a Dw of 8–9 μm.

When image formation was performed in the same manner as in Example 1, the resultant color toner images showed a poor transfer efficiency including $T_1$=83–85%, $T_2$=80% and $T_{overall}$=66.4–68.0%. Further, an offset phenomenon was confirmed at the time of the fixation.

Comparative Example 4

Irregular-shaped four color toner particles were respectively prepared in the same manner as in Comparative Example 1 (pulverization method) except that the addition amount (15 wt. parts) of the ester wax (Ex. wax No. (1)) was changed to 35 wt. %. Each of the four color toner particles showed an SF-1 of 151–154 and a Dw of 8.2–8.5 μm.

When image formation was performed in the same manner as in Example 1, toner sticking onto the photosensitive member 1 or the intermediate transfer member 5 occurred during the durability test, and the resultant color toner images showed a poor transfer efficiency including $T_{overall}$= 50% and also showed a considerable transfer unevenness.

Figure 3:
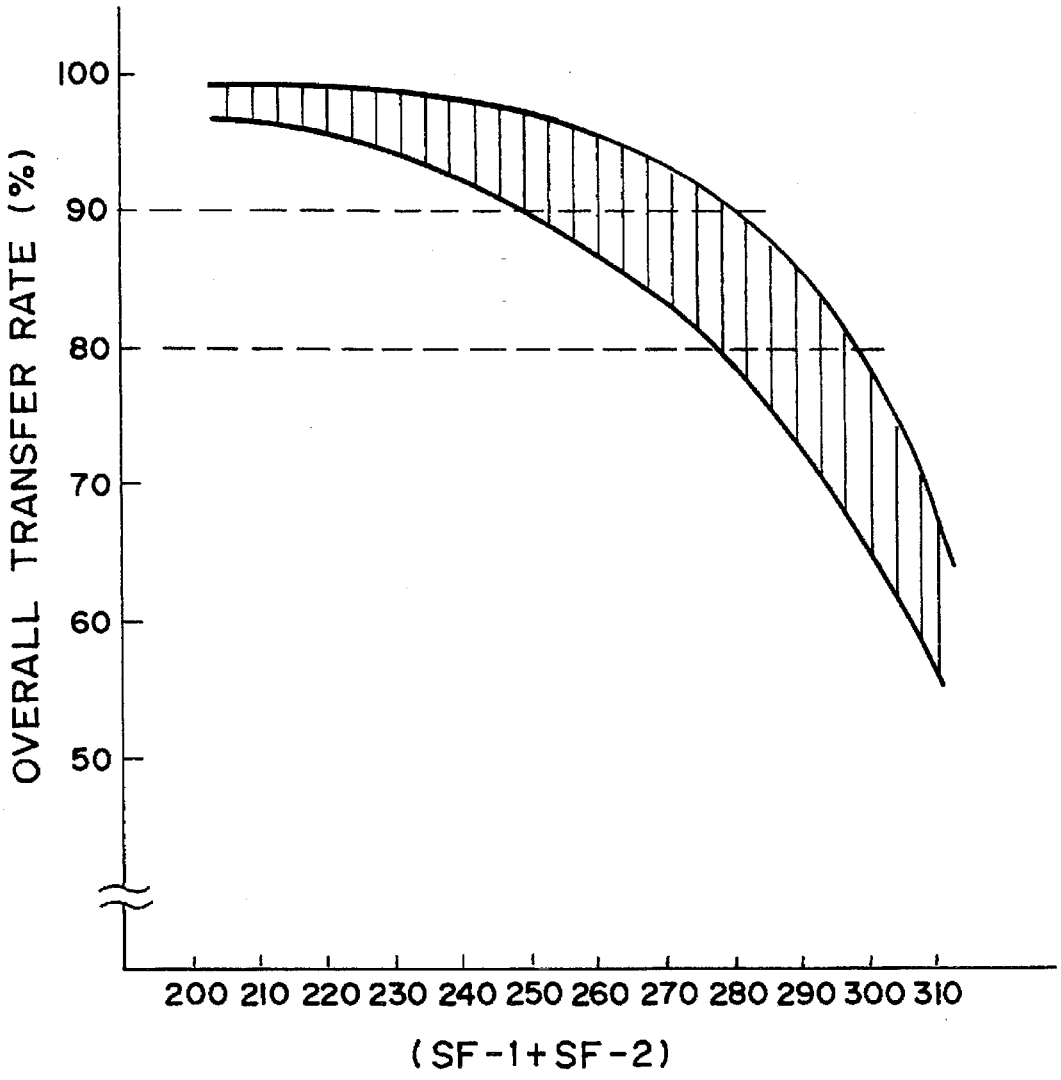
FIG. 3 is a graph showing a relationship between shape factors (SF-1+SF-2) and overall transfer rate of toner particles used in the present invention.

Various toner particles having different shape factors (SF-1 and SF-2) (including those used in Examples and Comparative Examples described above) were subjected to measurement of an overall transfer ratio ($T_{overall}$) in the above-mentioned manner. The results are shown i FIG. 3 which is a graph showing a relationship between $T_{overall}$ and the sum of SF-1 and SF-2. As apparent from FIG. 3, the sum of SF-1 and SF-2 (SF-1+SF-2) may preferably be at most 275 in order to stably attain a $T_{overall}$ of at least 80%. Further, (SF-1+SF-2) may more preferably be at most 240 in order to stably attain a $T_{overall}$ of at least 90%.

What is claimed is:

1. An image forming method for forming a multi-color or full-color image comprising the steps of:

forming an electrostatic image on a electrostatic image-bearing member, developing the electrostatic image with color toner particles having a first shape factor (SF-1) of 100–150 and containing a binder resin and a low-softening point substance to form a color toner image on said electrostatic image-bearing member, wherein said color toner particles contain said low-softening point substance in an amount of 5–30 wt. %, transferring the color toner image on said electrostatic image-bearing member to an intermediate transfer member which has been voltage-applied, transferring the color toner image on said intermediate transfer member to a transfer-receiving material by a transfer means which has been voltage-applied, and heat-fixing the color toner image on said transfer-receiving material to form said multi-color or full-color image.

2. The image forming method according to claim 1, including the step of developing the electrostatic image with the color toner particles having a second shape factor (SF-2) of 100–140.

3. The image forming method according to claim 2, including the step of developing the electrostatic image with the color toner particles having an SF-2 of 100–130.

4. The image forming method according to claim 3, including the step of developing the electrostatic image with the color toner particles having an SF-2 of 100–125.

5. The image forming method according to claim 2, including the step of developing the electrostatic image with the color toner particles having an SF-1 of 100–125, and SF-2 of 100–130, insulating properties and triboelectric charge.

6. The image forming method according to claim 2, including the step of developing the electrostatic image with the color toner particles having a sum of an SF-1 and SF-2 being at most 275.

7. The image forming method according to claim 6, including the step of developing the electrostatic image with the color toner particles having a sum of an SF-1 and SF-2 being at most 275.

8. The image forming method according to claim 1, including the step of developing the electrostatic image with the color toner particles having insulating properties and triboelectric charge.

9. The image forming method according to claim 1, including the step of developing the electrostatic image with the color toner particles having an SF-1 of 100–125.

10. The image forming method according to claim 9, including the step of developing the electrostatic image with the color toner particles having an SF-1 of 100–110.

11. The image forming method according to claim 1, including the step of developing the electrostatic image with the color toner particles having an SF-1 of 100–110, an SF-2 of 100–125, insulating properties and triboelectric charge.

12. The image forming method according to claim 1, including the step of developing the electrostatic image with the color toner particles comprising non-magnetic cyan toner particles.

13. The image forming method according to claim 1, including the step of developing the electrostatic image with the color toner particles comprising non-magnetic yellow toner particles.

14. The image forming method according to claim 1, including the step of developing the electrostatic image with the color toner particles comprising non-magnetic magenta toner particles.

15. The image forming method according to claim 1, including the step of developing the electrostatic image with the color toner particles comprising magnetic black toner particles.

16. The image forming method according to claim 1, including the step of developing the electrostatic image with the color toner particles comprising non-magnetic black toner particles.

17. The image forming method according to claim 1, including the step of developing the electrostatic image with the color toner particles having a weight-average particle size of at most 10 μm and a coefficient of variation in number of at most 35%.

18. The image forming method according to claim 1, including the step of developing the electrostatic image with the color toner particles having a weight-average particle size of 4–8 μm and a coefficient of variation in number of at most 35%.

19. The image forming method according to claim 17 or 18, including the step of developing the electrostatic image with the color toner particles having a coefficient of variation in number of at most 30%.

20. The image forming method according to claim 1, wherein a first electrostatic image is formed on said electrostatic image-bearing member and developed with cyan toner particles to form a cyan toner image, which is transferred to said intermediate transfer member;

a second electrostatic image is formed on said electrostatic image-bearing member and developed with yellow toner particles to form a yellow toner image, which is transferred to said intermediate transfer member;

a third electrostatic image is formed on said electrostatic image-bearing member and developed with magenta toner particles to form a magenta toner image, which is transferred to said intermediate transfer member;

a fourth electrostatic image is formed on said electrostatic image-bearing member and developed with black toner particles to form a black toner image, which is transferred to said intermediate transfer member;

the cyan toner image, the yellow toner image, the magenta toner image and the black toner image on said intermediate transfer member are transferred to a transfer-receiving material; and the cyan toner image, the yellow toner image, the magenta toner image and the black toner image on said transfer-receiving material are fixed thereon under application of heat and pressure to form a multi-color image or a full-color image.

21. The image forming method according to claim 1, including the step of transferring the color toner image to said intermediate transfer member having an elastic layer.

22. The image forming method according to claim 21, including the step of transferring the color toner image to said intermediate transfer member, wherein said elastic layer has a medium resistance and is formed on a core metal to which a voltage is applied.

23. The image forming method according to claim 22, including the step of transferring the color toner image to said intermediate transfer member, wherein said elastic layer has a volume resistivity of $10^5$–$10^{11}$ ohm.cm.

24. The image forming method according to claim 23, including the step of transferring the color toner image to said intermediate transfer member, wherein said elastic layer has a volume resistivity of $10^7$–$10^{10}$ ohm.cm.

25. The image forming method according to claim 1, including the step of transferring the color toner image to the transfer-receiving material employing the transfer means which includes a transfer roller to which a voltage is applied.

26. The image forming method according to claim 25, including the step of transferring the color toner image to the transfer-receiving material employing the transfer means, wherein said transfer roller has an elastic layer.

27. The image forming method according to claim 1, including the step of developing the electrostatic image with the color toner particles containing said low-softening point substance inside thereof.

28. The image forming method according to claim 1, including the step of developing the electrostatic image with the color toner particles, wherein said toner particles are directly produced by suspension polymerization.

29. The image forming method according to claim 1, including the step of developing the electrostatic image with the color toner particles, wherein said toner particles are directly produced by emulsion polymerization.

30. The image forming method according to claim 1, including the step of developing the electrostatic image with the color toner particles, wherein said low-softening point substance provides a DSC curve showing a temperature corresponding to a maximum heat absorption peak of 40°–90° C.

31. The image forming method according to claim 30, including the step of developing the electrostatic image with the color toner particles, wherein said low-softening point substance comprises an ester wax having a long-chain alkyl group.

32. The image forming method according to claim 1, including the step of developing the electrostatic image with the color toner particles, wherein said low-softening point substance has a softening point of 40°–150° C.

33. The image forming method according to claim 32, including the step of developing the electrostatic image with the color toner particles, wherein said low-softening point substance comprises a compound selected from a group consisting of paraffin wax, polyolefin wax, Fischer-Tropsch wax, amide wax, higher fatty acid, ester wax, and derivatives thereof.

34. An image forming method for forming a full-color image, comprising the steps of:

forming an electrostatic image on a electrostatic image-bearing member, developing the electrostatic image with color toner particles having a first shape factor (SF-1) of 100–110 and containing a binder resin and a low-softening point substance in an amount of 5–30 wt. % to form a color toner image on said electrostatic image-bearing member, transferring the color toner image on said electrostatic image-bearing member to an intermediate transfer member which has been voltage-applied, transferring the color toner image on said intermediate transfer member to a transfer-receiving material by a transfer roller which has been voltage-applied, and heat-fixing the color toner image on said transfer-receiving material.

35. The image forming method according to claim 34, including the step of transferring the color toner image to the transfer-receiving material employing the transfer means, wherein said intermediate transfer member and said transfer roller each have an elastic layer.

36. The image forming method according to claim 35, including the step of transferring the color toner image to the transfer-receiving material employing the transfer means, wherein said elastic layer of said intermediate transfer member has a higher volume resistivity than said elastic layer of said transfer roller.

37. The image forming method according to claim 36, wherein said intermediate transfer member has a surface hardness of 10–40 as measured by JIS K-6301, said transfer roller has a higher surface hardness than said intermediate transfer member and is pressed against said intermediate transfer member to form a nip in a concave shape with respect to said intermediate transfer member; and a voltage is applied to said transfer roller thereby to transfer the color toner image on said intermediate transfer member to said transfer-receiving material.

38. The image forming method according to claim 34, including the step of developing the electrostatic image with the color toner particles having an outer resin layer containing said low-softening point substance inside thereof and are produced by direct polymerization.

39. The image forming method according to claim 38, including the step of developing the electrostatic image with the color toner particles, wherein said toner particles are produced by suspension polymerization.

40. The image forming method according to claim 34, including the step of transferring the color toner image to said intermediate transfer member, wherein said intermediate transfer member comprises an elastic roller having an elastic layer showing a medium resistance.

41. The image forming method according to claim 34, including the step of developing the electrostatic image with the color toner particles, wherein said low-softening point substance comprises an ester wax having at least one long-chain alkyl group having 10 or more carbon atoms.

* * * * *

UNITED STATES PATENT AND TRADEMARK OFFICE

CERTIFICATE OF CORRECTION

PATENT NO. : 5,659,857

DATED : August 19, 1997

INVENTOR(S) : MASUO YAMAZAKI ET AL.

It is certified that error appears in the above-identified patent and that said Letters Patent is hereby corrected as shown below:

On the title page item

[57] ABSTRACT

Line 2, "a" should read --an--.
Line 15, "at" (first occurrence) should read --be at--.

COLUMN 1

Line 13, "have" should read --has--.
Line 14, "used" should read --used a--.

COLUMN 2

Line 2, "of" should read --of the--.

COLUMN 3

Line 3, "on a" should read --on an--.
Line 21, "on a" should read --on an--.

COLUMN 4

Line 34, "if a" should read --if an--.
Line 47, "my" should read --may--.
Line 62, "also a" should read --also an--.

COLUMN 5

Line 1, "an" should read --a--.
Line 11, "a" should read --on a--.
Line 23, "be" should read --to be--.

UNITED STATES PATENT AND TRADEMARK OFFICE

CERTIFICATE OF CORRECTION

PATENT NO. : 5,659,857

DATED : August 19, 1997

INVENTOR(S) : MASUO YAMAZAKI ET AL.

It is certified that error appears in the above-identified patent and that said Letters Patent is hereby corrected as shown below:

COLUMN 6

Line 12, "contains" should read --contain--.
Line 59, "use" should read --uses--.

COLUMN 9

Line 11, "case" should read --the case--.
Line 17, "particle" should read --particles--.
Line 24, "images" should read --image--.
Line 41, "e.g.," should read --e.g., a--.
Line 42, "in" should read --in a--.

COLUMN 10

Line 21, "an" should be deleted.

COLUMN 11

Line 5, "addition" should read --additive--.
Line 8, "a shape" should read --the shape--.
Line 17, "are" should read --is--.

COLUMN 12

Line 9, "solution)" should read --solution).--.
Line 36, "yellow" should read --a yellow--.
Line 51, "an" should read --and--.

UNITED STATES PATENT AND TRADEMARK OFFICE

CERTIFICATE OF CORRECTION

PATENT NO. : 5,659,857

DATED : August 19, 1997

INVENTOR(S) : MASUO YAMAZAKI ET AL.

It is certified that error appears in the above-identified patent and that said Letters Patent is hereby corrected as shown below:

COLUMN 13

Line 31, "using" should read --using a--.
Line 34, "it is" should read --it is possible to--.
Line 37, "the" (second occurrence) should be deleted.
Line 47, "tion" should read --tive--.

COLUMN 14

Line 48, "oder" should read --odor--.

COLUMN 15

Line 11, "mean" should read --means--.
Line 15, "be" should read --be a--.
Line 24, "and little cause" should read --and causes little--.
Line 40, "performed" should read --be performed--.

COLUMN 16

Line 51, "may" should be deleted.

COLUMN 17

Line 14, "prise" should read --prises--.

UNITED STATES PATENT AND TRADEMARK OFFICE

CERTIFICATE OF CORRECTION

PATENT NO. : 5,659,857

DATED : August 19, 1997

INVENTOR(S) : MASUO YAMAZAKI ET AL.

It is certified that error appears in the above-identified patent and that said Letters Patent is hereby corrected as shown below:

COLUMN 18

Line 31, "to a" should read --to an--.
Line 39, "provides" should read --provide--.
Line 61, "lenediene" should read --lene-diene--.

COLUMN 19

Line 8, "form to" should read --to form--.
Line 38, "sizes" should read --size--.

COLUMN 20

Line 27, "transfer" should read --transfers--.
Line 50, "at" should be deleted.
Line 51, "member" should read --members--.

COLUMN 21

Line 2, "after" should read --and after-- and "was" should read --were--.
Line 20, "whereby an" should read --thereby producing--.
Line 22, "was" should read --were--.
Line 52, "images" should read --images were produced--.
Line 57, "was" should read --was a--.

UNITED STATES PATENT AND TRADEMARK OFFICE

CERTIFICATE OF CORRECTION

PATENT NO. : 5,659,857

DATED : August 19, 1997

INVENTOR(S) : MASUO YAMAZAKI ET AL.

It is certified that error appears in the above-identified patent and that said Letters Patent is hereby corrected as shown below:

COLUMN 22

Line 10, "after" should read --and after-- and "was" should read --were--.
Line 41, "78.3%)." should read --78.3%.--.
Line 46, "level." should read --levels.--

COLUMN 23

Line 35, "i" should read --in--.

Signed and Sealed this

Thirty-first Day of March, 1998

Bruce Lehman

*Attest:*

BRUCE LEHMAN

*Attesting Officer*

*Commissioner of Patents and Trademarks*